US009903311B1

(12) United States Patent
Campbell et al.

(10) Patent No.: US 9,903,311 B1
(45) Date of Patent: Feb. 27, 2018

(54) ENGINE CAM COVER WITH INTEGRATED WIRING AND QUICK-CONNECT ELECTRICAL COMPONENTS

(71) Applicant: FORD GLOBAL TECHNOLOGIES, LLC, Dearborn, MI (US)

(72) Inventors: Hugh R. Campbell, Grosse Ile, MI (US); Joseph Fondren, Flushing, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 5 days.

(21) Appl. No.: 15/286,872

(22) Filed: Oct. 6, 2016

(51) Int. Cl.
*F02P 13/00* (2006.01)
*F02F 7/00* (2006.01)
*F02P 15/00* (2006.01)

(52) U.S. Cl.
CPC ..... *F02F 7/0068* (2013.01); *F02P 13/00* (2013.01); *F02P 15/00* (2013.01)

(58) Field of Classification Search
CPC ..... F02F 7/0068; F02P 13/00; F02P 15/00; F02P 15/006
See application file for complete search history.

(56) References Cited

U.S. PATENT DOCUMENTS 4,706,639 A 11/1987 Boyer et al.
5,390,648 A 2/1995 Yanase
5,771,850 A * 6/1998 Okada ..... F02F 7/006 123/143 C
6,494,193 B2 12/2002 Weingaertner et al.
2002/0162545 A1* 11/2002 Weingaertner ..... F02F 1/242 123/647

FOREIGN PATENT DOCUMENTS

EP 0512357 A2 11/1992

* cited by examiner

*Primary Examiner* — Jacob Amick
(74) *Attorney, Agent, or Firm* — Gregory P. Brown; MacMillan, Sobanski & Todd, LLC

(57) ABSTRACT

An engine cam cover with integrated wiring provides quick-connect capability for electrical components in a manner that simultaneously establishes electrical interconnection and mechanical fastening. The cover comprises a shell with inner and outer layers defining a plurality of sockets with respective passages for receiving respective electrical components. A wire bundle has a plurality of wires extending from a connector end at a periphery of the shell to a terminal end disposed within a space between the layers. A plurality of retainers are disposed in respective passages, each having at least one helical track for rotationally receiving a connector pin extending radially from a respective electrical component. A plurality of metal cups installed at an end of each helical track are connected to respective wires at a respective terminal end. Each socket is configured to provide a latch to hold each respective connector pin at the respective track end.

17 Claims, 4 Drawing Sheets

ENGINE CAM COVER WITH INTEGRATED WIRING AND QUICK-CONNECT ELECTRICAL COMPONENTS

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to engine covers, and, more specifically, to molded covers receiving electrical engine components such as sensors and coil-on-plug units.

An outer surface of an internal combustion engine may include various covers enclosing certain moving and/or lubricated parts such as valves or a camshaft. Depending on the particular type of engine, such a cover may be commonly referred to as a cam cover, valve cover, or rocker cover. All such covers are referred to herein as a cam cover.

Modern internal combustion engines utilize multiple ancillary electrical components attached to their cam covers. These components may require large engine harnesses and a variety of electrical connectors. Potential disadvantages associated with engine harnesses and their associated electrical connectors may include problems with "hanking" of the harness on the outside of the cam cover, difficulties in making intermediate splices within the wire harness, incomplete seating of connectors, and missed connections during assembly or servicing of a vehicle. When a problem occurs, correction could require a simple reconnect to a much more expensive diagnosis with multiple component replacements and wire harness repairs of pigtail connectors.

In addition to complexity associated with the wiring, electrical components mounted to the cam cover such as a camshaft position sensor, camshaft timing solenoid, coil-on-plug unit, wastegate solenoid, wastegate vacuum sensor, engine temperature and pressure sensors, or a throttle body have required separate mechanical fasteners. The separate fasteners increase the complexity of both assembly and servicing of a vehicle as well as the cost.

SUMMARY OF THE INVENTION

The invention embeds electrical wires and contacts for the electrical components within a plastic molded cover which also forms integrated mounting features to eliminate separate mechanical fasteners. In one preferred embodiment, a flat ribbon-style wire harness is sealed between two plastic layers which are joined around their periphery by vibration welding. A locking feature is preferably provided for each electrical component which simultaneously obtains electrical contact and mechanical retention. For example, robust metal pin contacts on a component slide inside a helical groove during assembly to the plastic cam cover and are captured in mating metal cup contacts. The metal cups are attached to the wire harness inside the cover. An electrical connector at the opposite end of the embedded wire harness connects to an external harness in order to complete the electrical circuits necessary for the installed electrical components to function. The resulting cam cover is less cluttered with wires and connectors, and the number of electrical connectors that could be missed or improperly installed during production assembly is reduced.

In one particular aspect of the invention, a sealed cover for a combustion engine apparatus comprises a shell having molded inner and outer layers attached together and providing a sealing surface around an outer periphery. The shell defines a plurality of sockets providing respective passages through the layers for interfacing respective electrical components to the combustion engine. A wire bundle has a plurality of wires extending from a connector end disposed outside the shell to a terminal end disposed within a space between the inner and outer layers. A plurality of retainers are each disposed in a respective passage and having at least one helical track for rotationally receiving a connector pin extending radially from a respective electrical component. A plurality of metal cups are each installed at an end of a respective helical track and each connected to a respective wire at a respective terminal end. Each socket is configured to provide a latch to hold each respective connector pin at the respective track end.

DETAILED DESCRIPTION OF PREFERRED EMBODIMENTS

Figure 1:
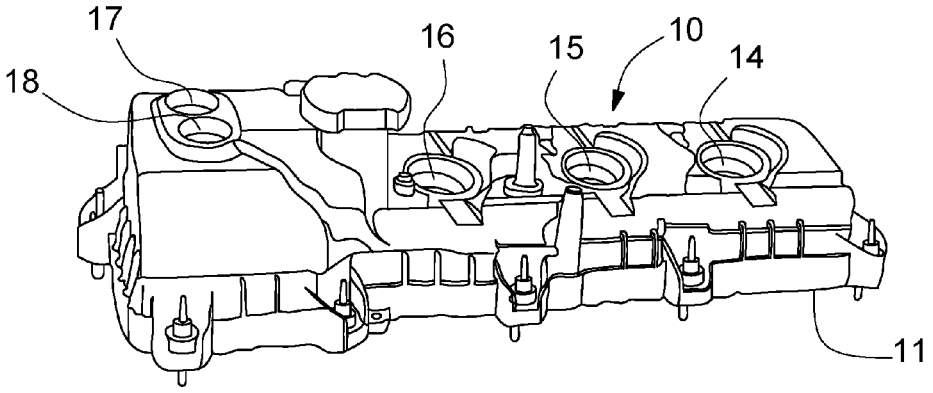
Fig. 1 (Prior Art)
FIG. 1 is a perspective view of a prior art valve cover.
Figure 2:
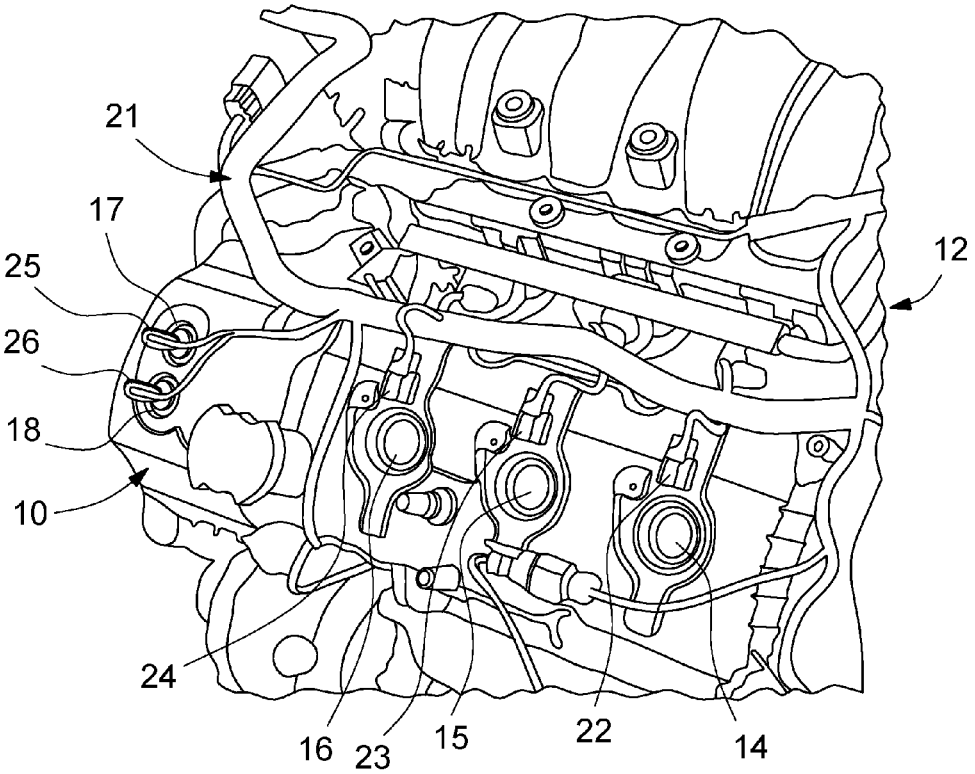
Fig. 2 (Prior Art)
FIG. 2 is a perspective view of the cover of FIG. 1 with an engine and a wiring harness.
Figure 3:
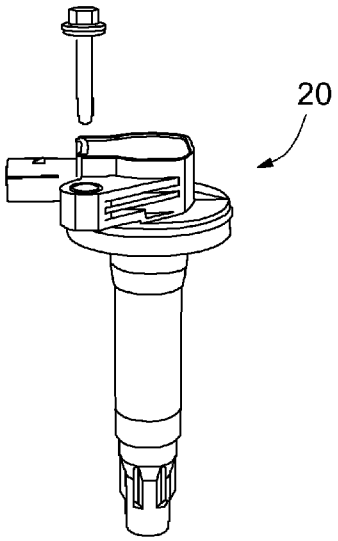
Fig. 3 (Prior Art)
FIG. 3 is a side view of a conventional coil-on-plug unit and mechanical fastener.

Referring to FIGS. 1 and 2, a dome-shaped cam cover 10 with a periphery 11 is mounted on an engine 12. Cover 10 is preferably comprised of a molded plastic body including a plurality of sockets 14-18 for receiving respective electrical components of the combustion engine 12. The electrical components may include a coil-on-plug unit 20 as shown in FIG. 3 which passes through cover 10 to connect with a spark plug (not shown) on engine 12. Sockets 14-16 are adapted to receive coil on plug units and sockets 17 and 18 are adapted to receive respective sensors.

In a prior art architecture shown in FIG. 2, a wiring harness 21 includes a thick wire bundle from which various wiring sections and connectors emerge, such as connectors 22-24 associated with sockets 14-16 and connectors 25 and 26 associated with sockets 17 and 18. Thus, installation or servicing of cam cover 10 involves the connection and/or disconnection of numerous electrical connectors associated with the electrical components. Moreover, separate electrical and mechanical connectors and/or fasteners are required for servicing each electrical component, and sufficient space must be maintained surrounding cover 10 in order to accommodate all the fasteners and connectors.

Figure 4:
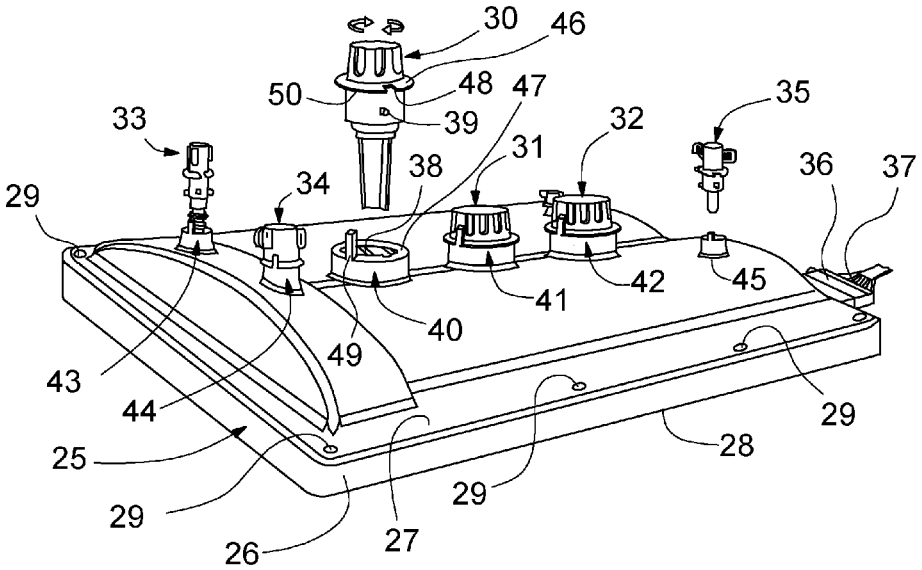
FIG. 4 is a perspective view of one embodiment of a cam cover of the present invention.
Figure 5:
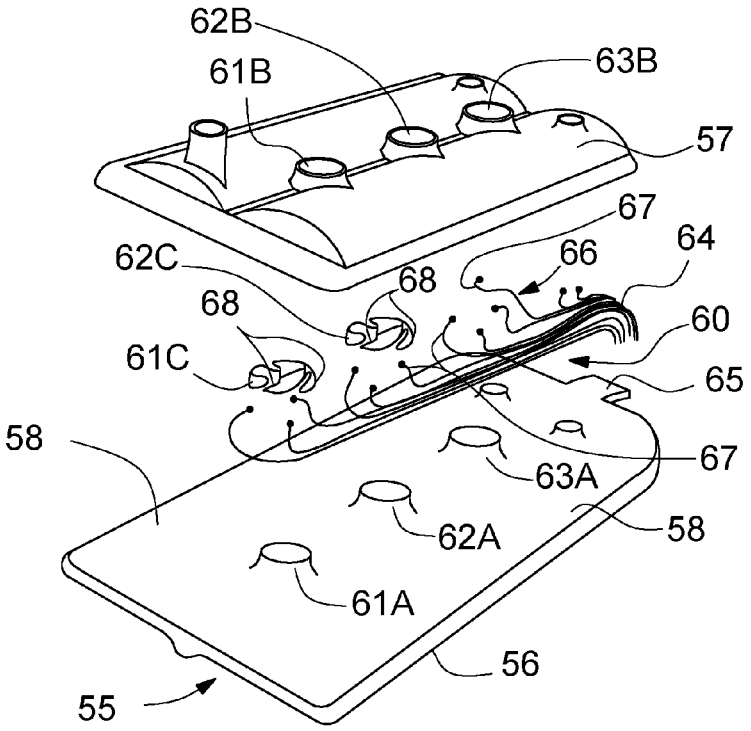
FIG. 5 is an exploded, perspective view of another embodiment of a cam cover of the present invention.

FIG. 4 shows a sealed cam cover 25 formed as a dome-like shell with a molded inner layer 26 and a molded outer layer 27 providing a sealing surface 28 around an outer periphery. Sealing surface 28 may receive a gasket (not shown) to obtain a hermetic seal with an engine. Cover 25 is attached to the engine (not shown) using fasteners such as threaded bolts passing through a plurality of attachment bores 29. A plurality of electrical components including coil-on-plug units 30-32, variable camshaft timing solenoid valves 33 and 34, and a camshaft position sensor 35, are mounted within (i.e., interfaced with) respective passages defined by sockets 40-45 of shell cover 25.

A wire bundle having a plurality of wires for interconnecting with electrical components 30-35 is partially contained within shell 25 between the layers 26 and 27. Alternatively, the wires can be insert molded within shell 25. The wire bundle has a connector end 36 at an edge of shell 25 adapted to connect with an external wiring harness connector 37.

In order to simultaneously obtain electrical interconnection and mechanical fastening of electrical components 30-35, sockets 40-45 and electrical components 30-35 include specially cooperating features that achieve a quick connect or quick disconnect in one manual operation without tools.

In particular, each electrical component has a plurality of connector pins extending radially from a central body. For example, a pin 39 projecting radially from coil-on-plug unit 30 is connected internally to the constituent circuitry of unit 30. Together with the central body of unit 30, pin 39 has structural robustness sufficient to carry a respective portion of the mechanical load that fastens unit 30 in place. The connector pins interact with retainers in each socket, wherein each retainer includes at least one helical track as shown by track 38 within socket 40. Track 38 is formed as a continuous channel similar to a screw thread. The angular spacing of pins 39 on each type of electrical component and the corresponding tracks 38 within sockets 40 are configured to be unsymmetrical to ensure correct "keyed" installation of the electrical components. When the corresponding electrical component is "screwed into" the respective socket, the connector pin is received into a specific helical track which concludes with a metal cup (not shown). Each metal cup is electrically connected to a respective wire of the wire bundle.

Each socket is configured to provide a latch that holds each respective connector pin at the end of the respective track in a manner that simultaneously achieves mechanical fastening and electrical interconnection. For example, a latch mechanism in FIG. 4 includes a radial notch 48 in a sealing flange 46. Flange 46 extends laterally from the central body of electrical component 30 and has a lower surface that seals against and bears on a socket surface 47 after component 30 has been rotationally inserted in socket 40 and connector pin 39 has reached the end of helical track 38 to enter a corresponding metal cup. Upon reaching full rotation, a flexible post 49 which extends in an axial direction at a periphery of socket 40 is captured in radial notch 48. Flange 46 preferably includes a ramp section 50 adjacent to radial notch 48 for gradually deflecting post 49 while component 30 is being inserted and rotationally installed into socket 40. In order to remove component 30, post 49 may be manually pulled in an outward radial direction from notch 48 so that counter-clockwise rotation of electrical component 30 can be applied to make the connector pins travel upward along the helical tracks. Preferably, each helical track spans 180° or less of rotation in each respective socket. Most preferably, the tracks span about a quarter turn.

FIGS. 5-8 illustrate another embodiment of the invention wherein a cover 55 has an inner layer 56 and an outer layer 57 formed of molded thermoplastic. Layers 56 and 57 are stacked to encapsulate a portion of a wire bundle 60 within an internal space that remains after layers 56 and 57 are vibration welded together along a peripheral welding track 58. Inner layer 56 has a plurality of raised collars 61A, 62A, and 63A that are aligned with raised collars 61B, 62B, and 63B on outer layer 57. The raised collars have matching openings corresponding to central passages for each socket. A plurality of retainers are arranged to further define the central passages between each respective pair of collars 61A-61B, 62A-62B, and 63A-63B, such as retainers 61C and 62C. The retainers (e.g., 61C and 62C) are attached to inner and outer layers 56 and 57 to complete the socket passageways (e.g., by adhesive bonding).

Wire bundle 60 may preferably be comprised of a flat ribbon cable. Wire bundle 60 has individual wires 66 extending from a connector end 64 to terminal ends of wires 66 which are connected to metal cups 67 (e.g., by soldering and/or crimping). Metal cups 67 are fixed in place at the ends of respective helical tracks 68 in the retainers (e.g., retainers 61C and 62C). Metal cups 67 can be bonded to the retainers, or captured between a respective retainer and raised collar.

Figure 6:
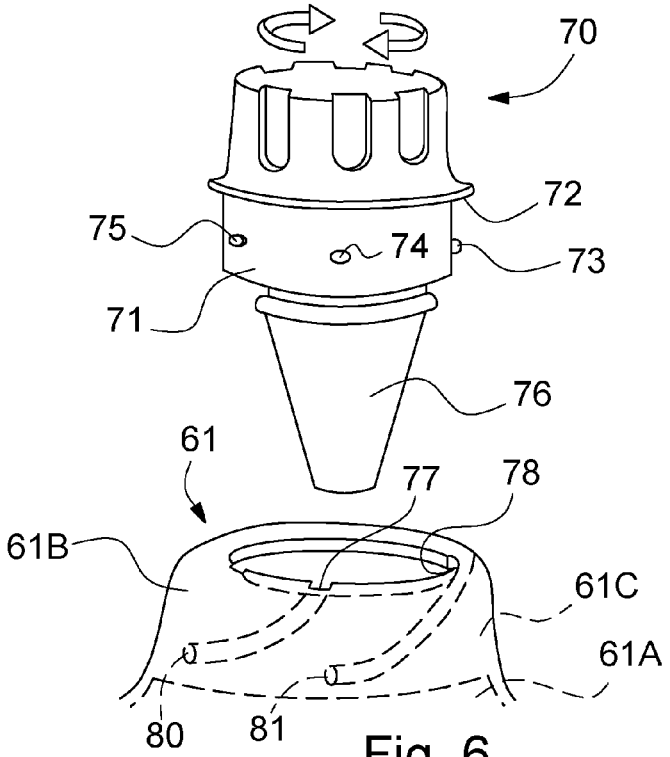
FIG. 6 shows a coil-on-plug unit configured to be attached to the cam cover of FIG. 5.
Figure 7:
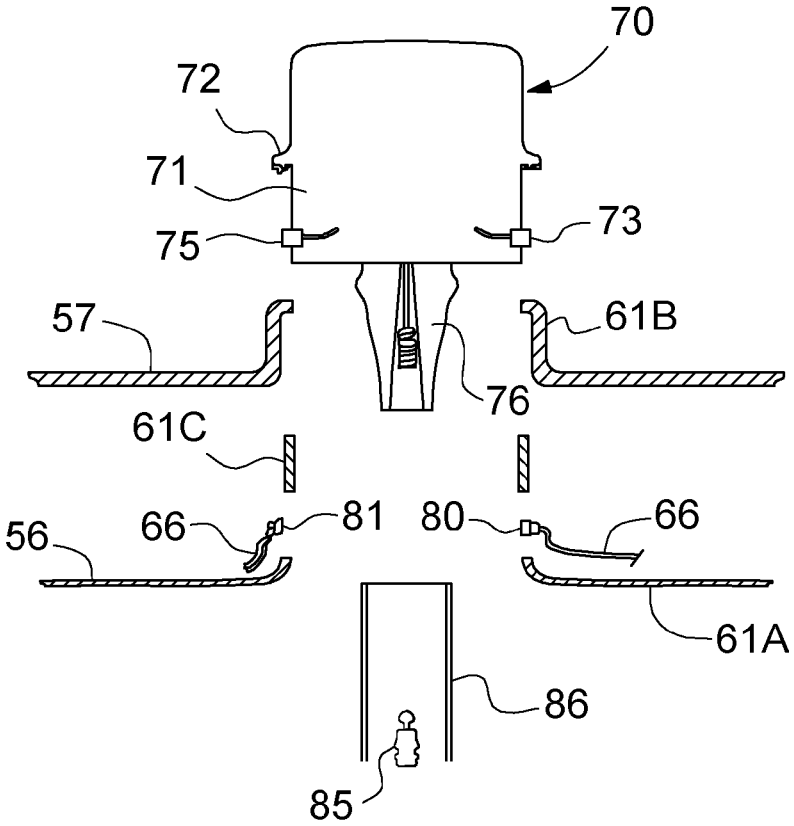
FIG. 7 is a cross-sectional view of the cam cover and coil-on-plug unit of FIGS. 5 and 6.

FIG. 6 shows a quick-connect mounting for a coil-on-plug unit 70 in a socket 61 in greater detail. Unit 70 has a central body 71 with a sealing flange 72 and metal connector pins 73-75 extending radially from central body 71. A spark plug socket (not shown) within a rubber boot 76 extends downward from unit 70 to pass through socket 61 in order to connect to a spark plug 85 (FIG. 7) within a spark plug tube 86 of an engine. Socket 61 includes helical tracks 77 and 78 in retainer 61C spiraling downward in socket 61. A circumferential spacing between helical tracks 77 and 78 matches a circumferential spacing between connector pins 73 and 74. By inserting pins 73-75 into the matching helical tracks and rotating unit 70, unit 70 is inserted into socket 61 until sealing flange 72 engages an upper surface of socket 61. Simultaneously, pins 73 and 74 engage metal cups 81 and 80, respectively, thereby making the electrical connections of unit 70 to the embedded wire bundle.

Figure 8:
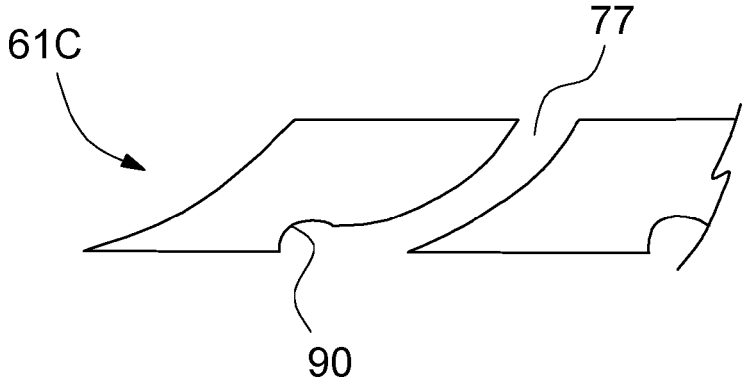
FIG. 8 is a partial, side view of a groove retainer seen along line A indicated in FIG. 7.

In order to simultaneously latch unit 70 at the fully installed position in socket 61, the bottom end of the helical tracks and/or the metal cups include a latching feature for acting on the connector pins of the electrical component as shown in FIG. 8. Thus, helical track 77 in retainer 61C defines a catch 90 as an indentation that captures a connector pin during assembly of the electrical component to the cam cover. Retainer 61C may be flexible so that catch 90 can snap into place over the connector pin during insertion of the electrical component. This mechanical retention of the electrical component can be reversed by counter-rotating the electrical component with enough force to bend retainer 61C to release the connector pin. Alternatively, a resilient sealing gasket can be used between the electrical component and the sealing surface of the socket so that a spring action from compressing the gasket can provide a force that retains the connector pin in catch 90.

What is claimed is:

1. A sealed cover for a combustion engine apparatus, comprising:

a shell having molded inner and outer layers attached together and providing a sealing surface around an outer periphery, wherein the shell defines a plurality of sockets providing respective passages through at least one layer for interfacing respective electrical components to the combustion engine;

a wire bundle having a plurality of wires extending from a connector end at an edge of the shell to a terminal end disposed within a space between the inner and outer layers;

a plurality of retainers each disposed in a respective passage and having at least one helical track for rotationally receiving a connector pin extending radially from a respective electrical component; and a plurality of metal cups each installed at an end of a respective helical track and each connected to a respective wire at a respective terminal end;

wherein each socket is configured to provide a latch to hold each respective connector pin at the respective track end.

2. The cover of claim 1 wherein at least one latch includes a capture notch formed as an enlargement of a corresponding helical track extending in an axial direction of the corresponding socket.

3. The cover of claim 1 wherein at least one latch includes a flexible post extending in an axial direction at a periphery of a corresponding socket, wherein the post is configured to be captured in a notched flange of a corresponding electrical component.

4. The cover of claim 3 wherein each helical track spans 180° or less of a respective socket.

5. The cover of claim 1 wherein the molded inner and outer layers are comprised of plastic, and wherein the inner and outer layers are joined by plastic welding.

6. The cover of claim 1 wherein the wire bundle is comprised of a flat ribbon cable.

7. The cover of claim 1 wherein the electrical components include a plurality of coil-on-plug units.

8. The cover of claim 1 wherein the electrical components include a plurality of sensors.

9. Combustion engine apparatus comprising:

an engine block;

a cover supported on the engine block; and a plurality of electrical components attached to the cover, each electrical component comprising a longitudinal body with at least one connector pin extending radially;

wherein the cover comprises:

a shell having molded inner and outer layers attached together and providing a sealing surface around an outer periphery, wherein the shell defines a plurality of sockets providing respective passages through the layers, each socket receiving a respective electrical component;

a wire bundle having a plurality of wires extending from a connector end at an edge of the shell to a terminal end disposed within a space between the inner and outer layers;

a plurality of retainers each disposed in a respective passage and having at least one helical track for rotationally receiving a respective connector pin; and a plurality of metal cups each installed at an end of a respective helical track and each connected to a respective wire at a respective terminal end;

wherein each socket is configured to provide a latch to hold each respective connector pin at the respective track end.

10. The apparatus of claim 9 wherein at least one latch includes a capture notch formed as an enlargement of a corresponding helical track extending in an axial direction of the corresponding socket to capture a corresponding connector pin.

11. The apparatus of claim 9 wherein at least one latch includes a flexible post extending in an axial direction at a periphery of a corresponding socket, wherein a corresponding electrical component includes a sealing flange for bearing against the corresponding socket, and wherein the flange includes a radial notch adapted to capture the post.

12. The apparatus of claim 11 wherein the sealing flange includes a ramp section adjacent to the radial notch.

13. The apparatus of claim 11 wherein each helical track spans 180° or less of a respective socket.

14. The apparatus of claim 9 wherein the molded inner and outer layers are comprised of plastic, and wherein the inner and outer layers are joined by plastic welding.

15. The apparatus of claim 9 wherein the wire bundle is comprised of a flat ribbon cable.

16. The apparatus of claim 9 wherein the electrical components include a plurality of coil-on-plug units.

17. The apparatus of claim 9 wherein the electrical components include a plurality of sensors.

* * * * *